US009909821B2

(12) United States Patent
Bardeleben et al.

(10) Patent No.: US 9,909,821 B2
(45) Date of Patent: Mar. 6, 2018

(54) HEAT EXCHANGER WITH SLIDE-ON MOUNTING BRACKET

(71) Applicant: Dana Canada Corporation, Oakville (CA)

(72) Inventors: Michael Bardeleben, Oakville (CA); Lee M. Kinder, Oakville (CA); Colin A. Shore, Hamilton (CA)

(73) Assignee: Dana Canada Corporation, Oakville, Ontario (CA)

( * ) Notice: Subject to any disclaimer, the term of this patent is extended or adjusted under 35 U.S.C. 154(b) by 258 days.

(21) Appl. No.: 14/707,165

(22) Filed: May 8, 2015

(65) Prior Publication Data

US 2015/0323266 A1 Nov. 12, 2015

Related U.S. Application Data

(60) Provisional application No. 61/990,408, filed on May 8, 2014.

(51) Int. Cl.

| | |
|---|---|
| ***F28F 9/00*** | (2006.01) |
| ***F28F 3/02*** | (2006.01) |
| ***F28F 9/007*** | (2006.01) |
| ***F28F 21/06*** | (2006.01) |
| ***F28F 21/08*** | (2006.01) |
| ***F28D 9/00*** | (2006.01) |

(52) U.S. Cl.

CPC ..... *F28F 9/002* (2013.01); *F28D 9/0056* (2013.01); *F28F 3/025* (2013.01); *F28F 9/0075* (2013.01); *F28F 21/06* (2013.01); *F28F 21/084* (2013.01); *F28F 2265/26* (2013.01)

(58) Field of Classification Search

CPC .... F02B 29/0462; F28F 9/002; F28F 2280/06

USPC ..... 165/67, 73, 74, 149

See application file for complete search history.

(56) References Cited

U.S. PATENT DOCUMENTS 2,615,687 A 10/1952 Simmons
4,303,052 A * 12/1981 Manfredo et al. ..... F01P 3/18 123/563

(Continued)

FOREIGN PATENT DOCUMENTS

GB 2235040 A 2/1991
WO 2012135956 A1 10/2012

OTHER PUBLICATIONS

International Search Report and Written Opinion for Application No. PCT/CA2015/050404, dated Jul. 29, 2015.

*Primary Examiner* — Allen Flanigan
(74) *Attorney, Agent, or Firm* — Marshall & Melhorn, LLC

(57) ABSTRACT

An elongate heat exchanger for cooling hot gas includes an arrangement for reducing thermal stresses when mounted in a housing. A pair of planar extensions project from opposite sides of the core. A mounting bracket has a central portion adapted to extend across the top of the core, and a pair of edge portions projecting outwardly from the central portion. The edge portions are substantially parallel to the planar extensions, and each has a top layer at least partially covering one of the planar extensions, wherein each of the edge portions is adapted to be secured to the housing, for example by a bolt. Each planar extension may be slidably received in a slot between the top and bottom layers of the edge portion, or may be slidably received between the top layer and the housing, to permit longitudinal thermal expansion of the core.

13 Claims, 18 Drawing Sheets

(56) References Cited

U.S. PATENT DOCUMENTS

| | | | | |
|---|---|---|---|---|
| 4,474,162 | A | 10/1984 | Mason | |
| 4,938,284 | A * | 7/1990 | Howells | F28F 9/001 165/149 |
| 6,513,579 | B1 | 2/2003 | Kent et al. | |
| 7,036,561 | B2 | 5/2006 | Yagi et al. | |
| 7,044,203 | B2 | 5/2006 | Yagi et al. | |
| 7,051,789 | B2 * | 5/2006 | Sheppard | F28F 9/002 165/149 |
| 7,267,159 | B2 | 9/2007 | Iwasaki et al. | |
| 7,302,997 | B2 * | 12/2007 | Kozdras et al. | F28F 9/002 165/153 |
| 8,016,025 | B2 | 9/2011 | Brost et al. | |
| 2002/0056541 | A1 * | 5/2002 | Kokubunji et al. | B60K 11/04 165/67 |
| 2007/0175617 | A1 * | 8/2007 | Brost et al. | F02B 29/0462 165/149 |
| 2007/0193731 | A1 * | 8/2007 | Lamich et al. | F28D 7/1623 165/149 |
| 2012/0255709 | A1 * | 10/2012 | Kinder et al. | F28F 9/002 165/67 |
| 2012/0258337 | A1 | 10/2012 | Wang | |
| 2014/0318751 | A1 | 10/2014 | Kinder et al. | |

* cited by examiner 10
12
14
16
18
20
22
24
26
30
34
36
38
40
42
46
48
70
72
74
76
78
80
82
84
94
96
98
100
102
104
124
125
x
y
z

HEAT EXCHANGER WITH SLIDE-ON MOUNTING BRACKET

CROSS-REFERENCE TO RELATED APPLICATION

This application claims priority to and the benefit of U.S. Provisional Patent Application No. 61/990,408 filed May 8, 2014, the contents of which are incorporated herein by reference.

FIELD OF THE INVENTION

The invention generally relates to mounting arrangements for heat exchangers, and particularly to mounting arrangements to minimize or avoid thermal stresses in heat exchangers.

BACKGROUND OF THE INVENTION

Heat exchangers for vehicles are typically rigidly mounted to vehicle components in order to prevent excessive movement and vibration. For example, many heat exchangers are provided with mounting brackets for connection of the heat exchanger to a housing or to another vehicle component. Rigid mounting can, however, constrain thermal expansion of the heat exchanger relative to the structure to which it is mounted, and this can cause thermal stresses in the heat exchanger. Over time, these thermal stresses can lead to premature failure of the heat exchanger.

Thermal stresses can be of particular concern in heat exchangers constructed from elongate tubes or elongate plates, in which stresses caused by longitudinal expansion of the tubes or plates can be significant.

There remains a need for mounting arrangements which reduce or avoid the damaging effects of thermal stresses caused by thermal expansion of heat exchangers, while at the same time avoiding excessive vibration of the heat exchanger.

SUMMARY OF THE INVENTION

According to one aspect, there is provided a heat exchanger comprising: (a) a core having a top, a bottom, a pair of sides, a first end and a second end, an inlet and an outlet for a first fluid, and an inlet and an outlet for a second fluid, the sides extending parallel to a longitudinal axis; (b) a first mounting arrangement for securing the first end of the core to a first surface; (c) a second mounting arrangement for securing the second end of the core to a second surface, wherein the second mounting arrangement comprises a pair of planar extensions located proximate to the second end of the core, each of the planar extensions being rigidly secured to one of the sides of the core and extending outwardly from the side to which it is secured; (d) a mounting bracket for securing the second end of the core to the second surface, wherein the mounting bracket has a central portion and a pair of edge portions attached to the central portion and projecting therefrom, wherein the central portion is adapted to cover a portion of the top of the core proximate to the second end thereof, and has a width sufficient to extend across the top of the core, wherein, with the central portion covering said portion of the top of the core, the edge portions project outwardly from opposite sides of the central portion and from opposite sides of the core, with each of the edge portions being substantially parallel to one of the planar extensions, and wherein each of the edge portions has a top layer with a width sufficient to at least partially cover one of the planar extensions with the central portion covering said portion of the top of the core, and wherein each of the edge portions is adapted to be secured to the second surface.

In an embodiment, the first mounting arrangement comprises a pair of planar extensions located proximate to the first end of the core, each of which is rigidly secured to one of the sides of the core and extends outwardly from the side to which it is secured. In an embodiment, each of the planar extensions located proximate to the first end of the core is adapted to be secured to the first surface, and may include an aperture for securing the first end of the core to the first surface with a mechanical fastener.

In an embodiment, the first and second mounting arrangements are both provided by a pair of mounting flanges, each of the mounting flanges extending axially along one of the sides of the core between the first and second ends, and each of the mounting flanges being rigidly secured to one of the sides and extending outwardly from the side to which it is secured, wherein the first mounting arrangement comprises portions of the mounting flanges located proximate to the first end of the core and the second mounting arrangement comprises portions of the mounting flanges located proximate to the second end of the core.

In an embodiment, each of the edge portions of the mounting bracket has an aperture through which it is adapted to be secured to the second surface with a mechanical fastener.

In an embodiment, the top layer of each of the edge portions includes an area which lies outside an edge of one of the planar extensions with the central portion of the mounting bracket covering said portion of the top of the core; and wherein each of the apertures in the edge portions is located in one of said outer areas, such that the edge portions are adapted to be secured directly to the second surface without passing through the planar extensions.

In an embodiment, the top layer of the edge portions are wider than the planar extensions, such that the outer areas are located outwardly of side edges of the planar extensions with the central portion of the mounting bracket covering said portion of the top of the core.

In an embodiment, each of the edge portions of the mounting bracket further includes a bottom layer, wherein the top and bottom layers are planar and are separated by a space sufficient to receive one of the planar extensions in axial sliding relation; wherein the top and bottom layers are joined along an axially extending line located outwardly of the side edge of the planar extension with the mounting bracket in the installed position, such that the space between the top and bottom layers of each of the mounting brackets defines an axially-extending slot which is open along its inner edge and closed along its outer edge.

In an embodiment, the axially extending line is located inwardly of the aperture in each of the edge portions.

In an embodiment, the mounting bracket protrudes beyond the second end of the core, and the outer areas of the edge portions are axially spaced from end edges of the planar extensions with the central portion of the mounting bracket covering said portion of the top of the core.

In an embodiment, each of the edge portions of the mounting bracket further includes a bottom layer, wherein the top and bottom layers are planar and are separated by a space sufficient to receive one of the planar extensions in axial sliding relation; wherein the top and bottom layers are joined along a transversely extending line located outwardly of the end edge of the planar extension with the mounting bracket in the installed position.

In an embodiment, the top and bottom layers are also joined along an axially extending line located outwardly of the side edge of the planar extension with the central portion of the mounting bracket covering said portion of the top of the core, such that the space between the top and bottom layers of each of the mounting brackets defines an axially-extending slot which is open along its inner edge and closed along its outer edge and along a transverse edge defined by said transversely extending line.

In an embodiment, the aperture in each of the edge portions of the mounting bracket is located in an area of the top layer which covers one of the planar extensions with the central portion of the mounting bracket covering said portion of the top of the core, and wherein each of the planar extensions includes an aperture which aligns with the aperture in one of the top layers with the central portion of the mounting bracket covering said portion of the top of the core, such that the planar extensions are adapted to be secured between the top layers of the edge portions and the second surface. In an embodiment, the apertures in the top layers are axially elongated. In an embodiment, the planar extensions include axially-extending portions which extend axially beyond the second end of the core, and wherein the apertures in the planar extensions are located in said axially-extending portions.

In an embodiment, the central portion of the mounting bracket has a top surface and a bottom surface, and wherein the bottom surface is adapted to engage the top of the core with the central portion of the mounting bracket covering said portion of the top of the core. In an embodiment, the top of the core includes axially extending indentations, and wherein the bottom surface of the mounting bracket includes projections which extend into the indentations with the central portion of the mounting bracket covering said portion of the top of the core.

In an embodiment, the first fluid is a liquid coolant, and the inlet and outlet for the first fluid both extend in a generally axial direction from the first end of the core. In an embodiment, the second fluid is a hot gas, and wherein the inlet for the second fluid is located at the top of the core, and the outlet for the second fluid is located at the bottom of the core. In an embodiment, the core comprises a plurality of spaced apart, elongate tubes, wherein flow passages for the first fluid are defined inside said tubes, and flow passages for the second fluid are defined between the tubes. In an embodiment, the core further comprises a pair of side plates defining the sides of the core and a pair of L-shaped brackets, each of the brackets having one leg rigidly secured to one of the side plates, and one leg comprising an outwardly extending flange which defines said first and second mounting arrangements.

In an embodiment, the heat exchanger further comprises a housing having an internal cavity adapted to receive the core, and axially-extending mounting surfaces extending along both sides of the cavity, wherein the mounting surfaces define both the first and second surfaces to which the first and second ends of the core are secured. In an embodiment, the second surface is recessed relative to the first surface, wherein each of the edge portions of the mounting bracket further include a bottom layer, wherein the top and bottom layers are separated by a space sufficient to receive one of the planar extensions in axial sliding relation, and wherein the bottom layer of the mounting bracket is secured to the second surface with the central portion of the mounting bracket covering said portion of the top of the core.

In an embodiment, the first and second mounting arrangements are both provided by a pair of mounting flanges, each of the mounting flanges extending axially along one of the sides of the core between the first and second ends, and each of the mounting flanges being rigidly secured to one of the sides and extending outwardly from the side to which it is secured, wherein the first mounting arrangement comprises portions of the mounting flanges located proximate to the first end of the core and the second mounting arrangement comprises portions of the mounting flanges located proximate to the second end of the core; wherein each of the edge portions of the mounting bracket further includes a bottom layer, wherein the top and bottom layers are separated by a space sufficient to receive a portion of one of the mounting flanges in axial sliding relation; wherein the space between the top and bottom layers of each of the mounting brackets defines an axially-extending slot; and wherein the mounting flanges each include a shoulder separating said portion of the mounting flange received between the top and bottom layers from a remainder of the mounting flange, wherein the remainder of the mounting flange has a bottom surface which is co-planar with a bottom surface of the bottom layer of the mounting bracket.

BRIEF DESCRIPTION OF THE DRAWINGS

The embodiments will now be described, by way of example only, with reference to the accompanying drawings in which.

DETAILED DESCRIPTION

The heat exchangers described herein are gas-liquid heat exchangers for cooling compressed charge air in a supercharged or turbocharged internal combustion engine, or in a fuel cell engine.

Figure 1:
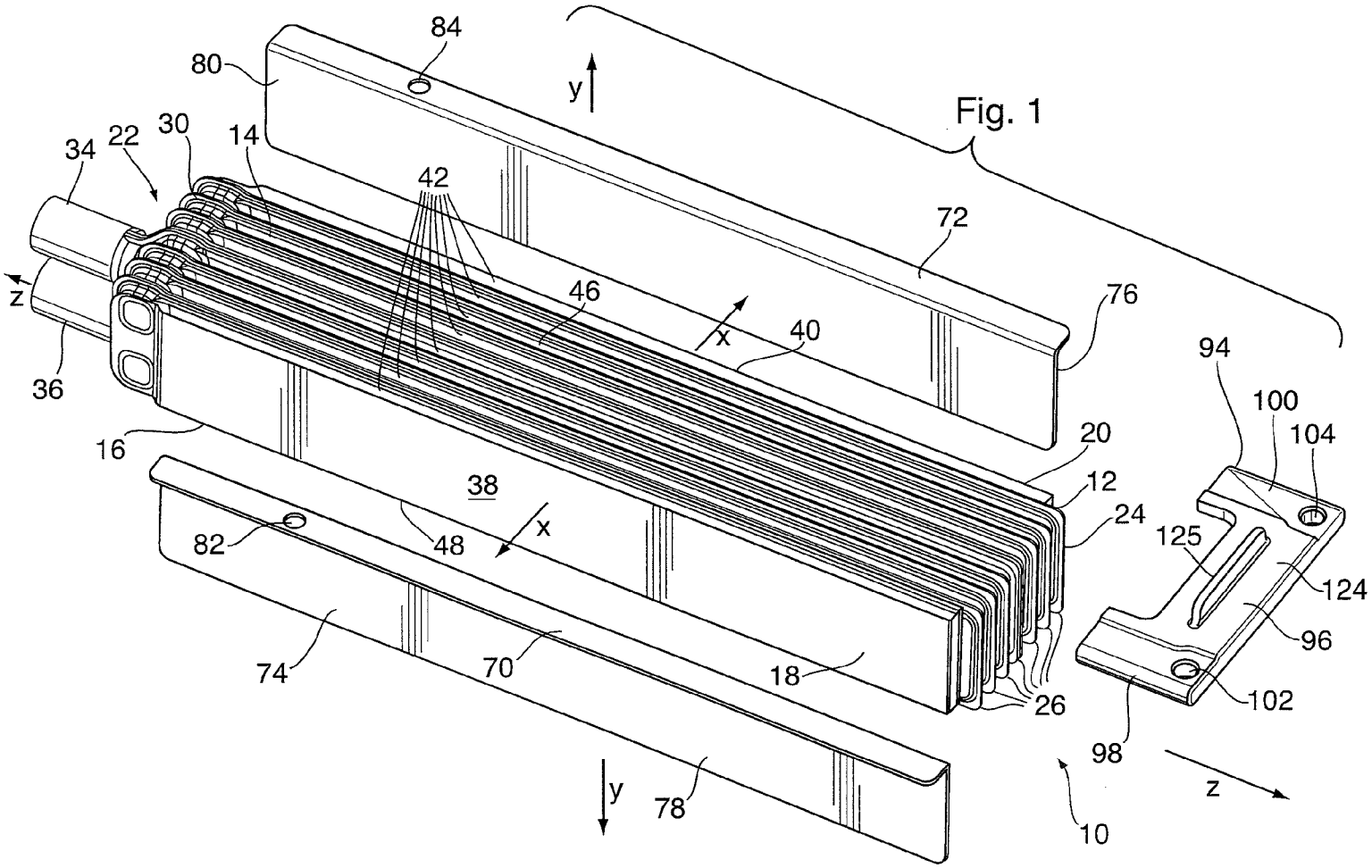
FIG. 1 is a partly disassembled perspective view of a heat exchanger according to a first embodiment.
Figure 3:
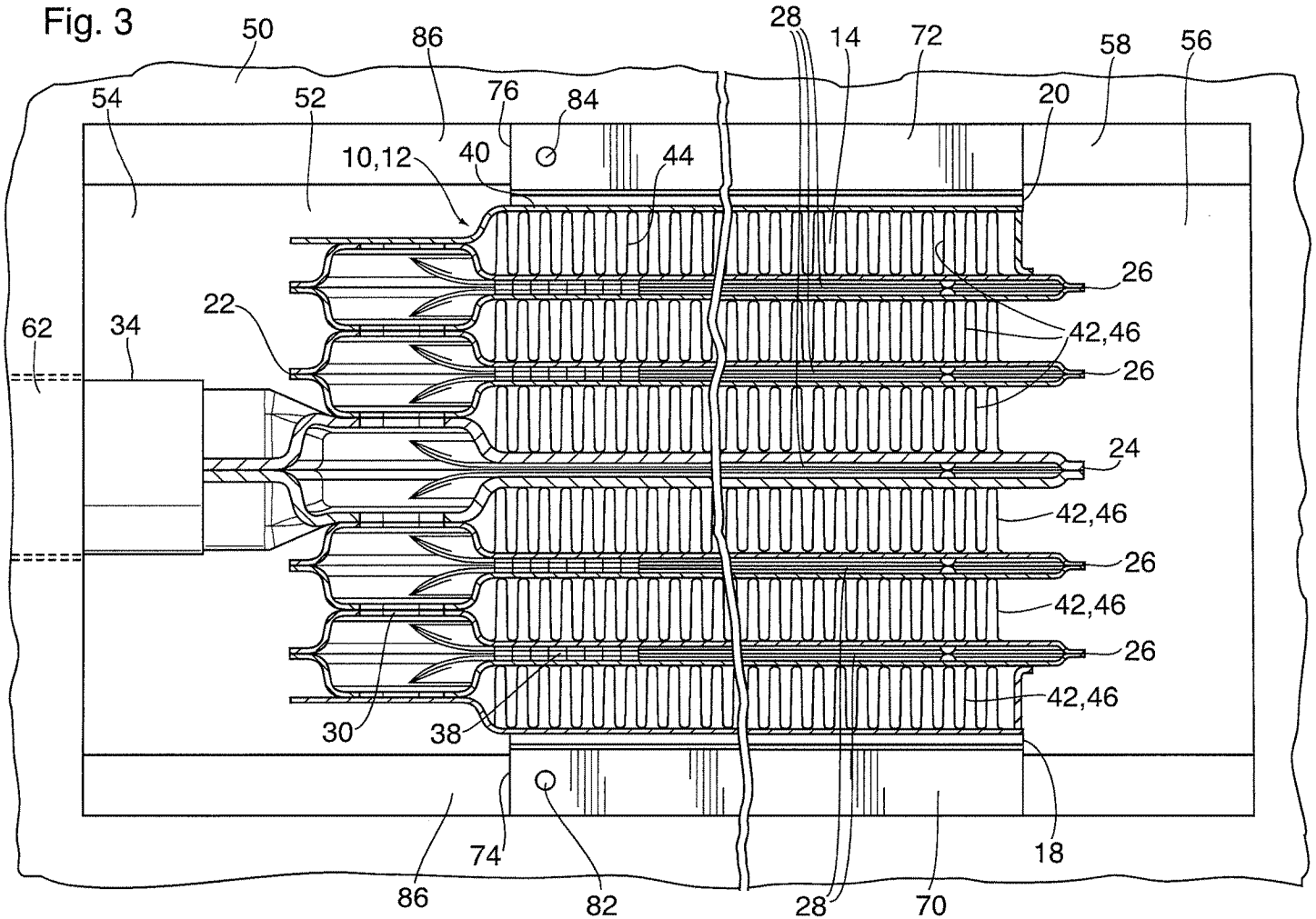
FIG. 3 is a top plan view, partly in cross-section, showing the heat exchanger of FIG. 1 installed in the housing.

FIGS. 1 and 3 illustrate a heat exchanger 10 similar to that described in commonly assigned U.S. patent application Ser. No. 13/440,064, published on Oct. 11, 2012 as US 2012/0255709 A1, and in commonly assigned U.S. patent application Ser. No. 14/250,779, published on Oct. 30, 2014 as US 2014/0318751 A1, both of which are incorporated herein by reference in their entireties.

Heat exchanger 10 is particularly configured for use in a supercharged internal combustion engine and has a relatively elongate, rectangular shape to supply intake air to a row of cylinders in the engine. In use, heat exchanger 10 will be enclosed within a housing and will be located in an air flow path between an air compressor (not shown) and the intake manifold of the engine (not shown).

Heat exchanger 10 includes a core 12 having a top 14 and an opposed bottom 16, a pair of opposed sides 18, 20, a first end 22 and a second end 24. The terms "top", "bottom", "sides" and "ends" are used herein for convenience only, and do not necessarily describe the orientation of the heat exchanger 10 when in use.

Heat exchanger 10 may have any desired construction, but in the illustrated embodiments the heat exchanger 10 is a plate and fin type heat exchanger, wherein the core 12 comprises a stack of flat, parallel elongate tubes 26 extending along longitudinal axis Z, each of which may be formed from a pair of core plates. The core 12 is elongate, having a length extending between ends 22, 24 along a longitudinal axis Z, a width extending between sides 18, 20 along axis X, and a height extending between top and bottom 14, 16 along axis Y, wherein axes X and Y are both transverse (perpendicular) to axis Z.

Each tube 26 has a hollow interior defining an internal coolant flow passage 28 through which a liquid coolant flows between an inlet opening and an outlet opening. The coolant flow passages 28 may be provided with turbulence-enhancing inserts (not shown). Each coolant flow passages 28 is U-shaped and communicates with coolant manifolds 30, 32 provided at the first end 22 of core 12, either of which may be the inlet manifold or outlet manifold. The core 12 further comprises coolant fittings 34, 36 which communicate with the respective coolant inlet and outlet manifolds 30, 32, either of which may be the inlet or outlet fitting. The fittings 34, 36 extend from the second end 24 of the core 12 in a generally longitudinal direction.

The heat exchanger core 12 further comprises side plates 38, 40 which close the ends of the coolant manifolds 30, 32 and which define the sides 18, 20 of the core 12.

Air flow passages 42 with corrugated cooling fins 44 are provided between adjacent pairs of tubes 26, and between the side plates 38, 40 and adjacent tubes 26. The cooling fins 44 may be provided throughout the height (along axis Y) and the length (along axis Z) of every air flow passage 42 in core 12. The air flow passages 42 are open at the top 14 and bottom 16 of core 12, wherein the open top 14 and bottom 16 define an air inlet 46 and an air outlet 48 respectively. It will be appreciated that the direction of air flow may be reversed such that the locations of the air inlet 46 and air outlet 48 are reversed.

The components comprising core 12 may all be formed from aluminum or an aluminum alloy, the components being joined together by brazing. The construction of core 12 is discussed in more detail in above-mentioned US Publication No. US 2012/0255709 A1.

In use, the heat exchanger 10 is installed in a housing 50, as mentioned above, between a compressor and the intake manifold of the engine so as to cool compressed charge air being fed to the engine. The housing 50 is only shown schematically in FIG. 2 and in other drawings, comprising an internal cavity 52 which is sized and shaped to receive heat exchanger 10. As will be explained further below, the cavity 52 is longer than core 12, such that gaps 54 and 56 are provided between the end walls of cavity 52 and the respective first and second ends 22, 24 of core 12. The cavity 52 has a depth sufficient to substantially completely enclose the sides 18, 20 and ends 22, 24 of core 12, and such that the top 14 of core 12 will be substantially flush with an upper peripheral edge 58 of cavity 52. The housing 50 may be a cast component comprised of aluminum or an aluminum alloy.

The bottom wall of cavity 52 may be provided with one or more air intake openings 60 communicating with the air intake manifold of the engine, and an end wall of cavity 52, proximate to the first end 22 of core 12, is provided with coolant ports 62, 64 which are sized to receive the coolant fittings 34, 36 of the heat exchanger 10 and to form a sealed connection with fittings 34, 36. The coolant ports 62, 64 are connected to a coolant circulation system (not shown).

The heat exchanger 10 is adapted to be mounted to the housing 50 at its first and second ends 22, 24. For this purpose, the heat exchanger 10 includes a first mounting arrangement for securing the first end 22 of the core 12 to a first surface of the housing 50, and a second mounting arrangement for securing the second end 24 of the core 12 to a second surface of the housing 50.

In the illustrated embodiments, the first and second mounting arrangements are provided by a pair of side mounting flanges 70, 72 extending continuously along the respective sides 18, 20 of the core 12, parallel to longitudinal axis Z, between the first and second ends 22, 24. As shown, the side mounting flanges 70, 72 extend outwardly from the sides 18, 20 of core 12, for example at an angle of about 90 degrees.

The side mounting flanges 70, 72 are rigidly secured to the sides 18, 20 of the core 12. For example, as shown, the side mounting flanges 70, 72 may form part of L-shaped side brackets 74, 76. In this regard, side mounting flange 70 comprises an outwardly extending leg of side bracket 74, which also includes a secured leg 78 which is rigidly secured to the side plate 38 of core 12. Similarly, side mounting flange 72 comprises an outwardly extending leg of side bracket 76, which also includes a secured leg 80 which is rigidly secured to the side plate 40. As shown, the side brackets 74, 76 are mounted so that the side mounting flanges 70, 72 are substantially or approximately co-planar with the top 14 of the core 12, although the exact locations of side mounting flanges 70, 72 may vary from one installation to another. The secured legs 78, 80 of side brackets 74, 76 are shown as extending throughout substantially the entire height of the core 12. However, it will be appreciated that this is not necessary, and the secured legs 78, 80 may be shorter than the core 12. Furthermore, although side mounting flanges 70, 72 form part of side brackets 74, 76, it will be appreciated that they may instead be integrated with the side plates 38, 40.

Although the first and second mounting arrangements may be provided by continuous axial flanges 70, 72, this is not necessary in all embodiments. Because the core 12 is secured only at its first and second ends 22, 24, the mounting arrangements do not necessarily extend continuously along the core 12. For example, the first mounting arrangement may comprise a pair of planar extensions located proximate to the first end 22 of core 12, each being rigidly secured to one of the sides 18, 20 of core 12 and extending outwardly from the side to which it is secured. Similarly, the second mounting arrangement may comprise a pair of planar extensions located proximate to the second end 24 of core 12, each being rigidly secured to one of the sides 18, 20 of core 12 and extending outwardly from the side to which it is secured. The planar extensions of the respective first and second mounting arrangements may be separately formed, or they may be formed as part of the same component, as described herein.

With the heat exchanger 10 installed in the cavity 52 of housing 50, the first end 22 of core 12 is rigidly secured to a first surface of the housing 50. In the illustrated embodiment, each of the side mounting flanges 70, 72 is provided with an aperture 82, 84 proximate to the first end 22 of core 12, and the first surface of the housing 50 comprises portions of a peripheral sealing surface 86 located proximate to the first end 22 of core 12. The peripheral sealing surface 86 surrounds the peripheral edge 58 of the cavity 52, and may comprise a substantially flat, planar surface extending at least along the elongate sides of cavity 52. The peripheral sealing surface 86 includes a pair of openings 88, 90 aligned with the apertures 82, 84 of side mounting flanges 70, 72. The openings 88, 90 may be threaded to receive bolts 92 or other mechanical fasteners for securing the side mounting flanges 70, 72 to the peripheral sealing surface 86 of housing 50 through the apertures 82, 84.

The heat exchanger 10 will undergo thermal expansion as it becomes heated during use. Being restrained at the first end 22, the core 12 must be permitted to expand along longitudinal axis Z so as to avoid the build-up of potentially damaging thermal stresses. Therefore, the second end 24 of core 12 will be secured to housing 50 in a manner which permits it to expand and contract longitudinally during use, while securely holding the heat exchanger 10 in position, as now described below.

The heat exchanger 10 further comprises a mounting bracket 94 for securing the second end 24 of core 12 to the second surface of the housing 50, so as to prevent movement and/or vibration of the heat exchanger 10 during use, while permitting longitudinal expansion and contraction of the core 12.

The mounting bracket 94, which may be constructed of a rigid plastic, has a central portion 96 and a pair of edge portions 98, 100 which are attached to the central portion 96. The mounting bracket 94 may have a unitary construction, and/or may be produced by molding.

The central portion 96 of mounting bracket 94 has a width (along axis X) which is sufficient to extend across the top 14 of core 12 at its second end 24, transversely to longitudinal axis X. This is defined herein as the "installation position" of the mounting bracket 94.

Each of the edge portions 98, 100 has a width (along axis X) sufficient to at least partially overlap the respective side mounting flanges 70, 72 at the second end 24 of core 12. Each of the edge portions 98, 100 is also adapted to be secured to the second surface of housing 50. In the first embodiment shown in FIGS. 1 to 7, the peripheral sealing surface 86 of the housing also includes the second surface, and therefore the edge portions 98, 100 of mounting bracket 94 at least partially overlap the peripheral sealing surface 86 proximate to the second end 24 of core 12, which defines the second surface of housing 50. This overlap can be seen, for example, in FIG. 3.

Extending through each of the edge portions 98, 100 of the mounting bracket 94 is an aperture 102, 104. Through these apertures 102, 104, the mounting bracket 94 is secured to the second surface of the housing 50, i.e. the peripheral sealing surface 86 proximate to second end 24, for example by mechanical fasteners such as bolts 92. Accordingly, the peripheral sealing surface 86 of housing 50 includes a pair of openings 106, 108 aligned with the apertures 102, 104 of edge portions 98, 100. The openings 106, 108 may be threaded to receive bolts 92 or other mechanical fasteners for securing the edge portions 98, 100 of mounting bracket 94 to the peripheral sealing surface 86.

The configuration of the mounting bracket 94 and the manner in which it secures the second end 24 of core 12 to housing 50 differs in the various embodiments described herein. For example, in the first embodiment, each of the edge portions 98, 100 includes an area which lies outside an edge of the side mounting flanges 70, 72 when the bracket 94 is in the installed position. It can be seen from FIGS. 4 and 6 that the apertures 102, 104 are located in an area which is located in such an outer area, and are located in an area which protrudes beyond the second end 24 of core 12 along longitudinal axis Z, and therefore the outer area in which apertures 102, 104 are located is spaced along axis Z from the end edges of the side mounting flanges 70, 72, with the bracket 94 in the installed position as shown in FIG. 4.

Figure 4:
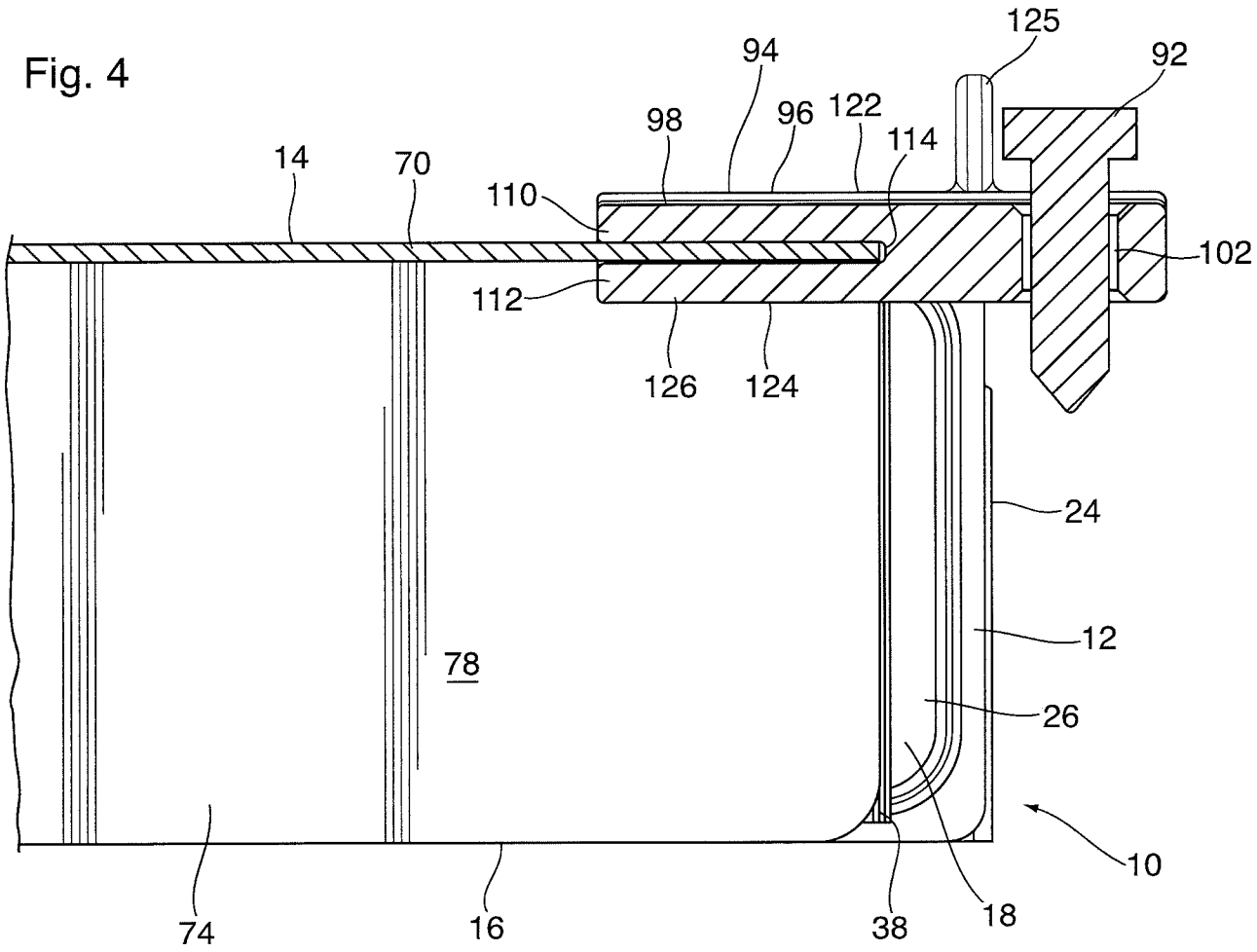
FIG. 4 is a partial, longitudinal cross-section through the second end of the heat exchanger of FIG. 1.

It can also be seen from FIG. 4 that the side mounting flange 70 is received in a space between a top layer 110 and a bottom layer 112 of the mounting bracket 94, this space forming a slot in which the side mounting flange 70 is axially slidable. This arrangement permits the side mounting flanges 70, 72 to slide within the slot between layers 110, 112 during installation of the bracket, and during longitudinal thermal expansion and contraction of the heat exchanger 10 during use.

The top and bottom layers 110, 112 are joined along a transversely extending line 114 which is located past the end edge of the side mounting flange 70, the transverse line 114 providing a stop to limit the axial sliding movement of the bracket 94 relative to the core 12. The transverse line also defines an edge of the outer area in which apertures 102, 104 are located, the outer area being solid rather than layered so as to provide additional strength and rigidity in the area of apertures 102, 104.

Figure 5:
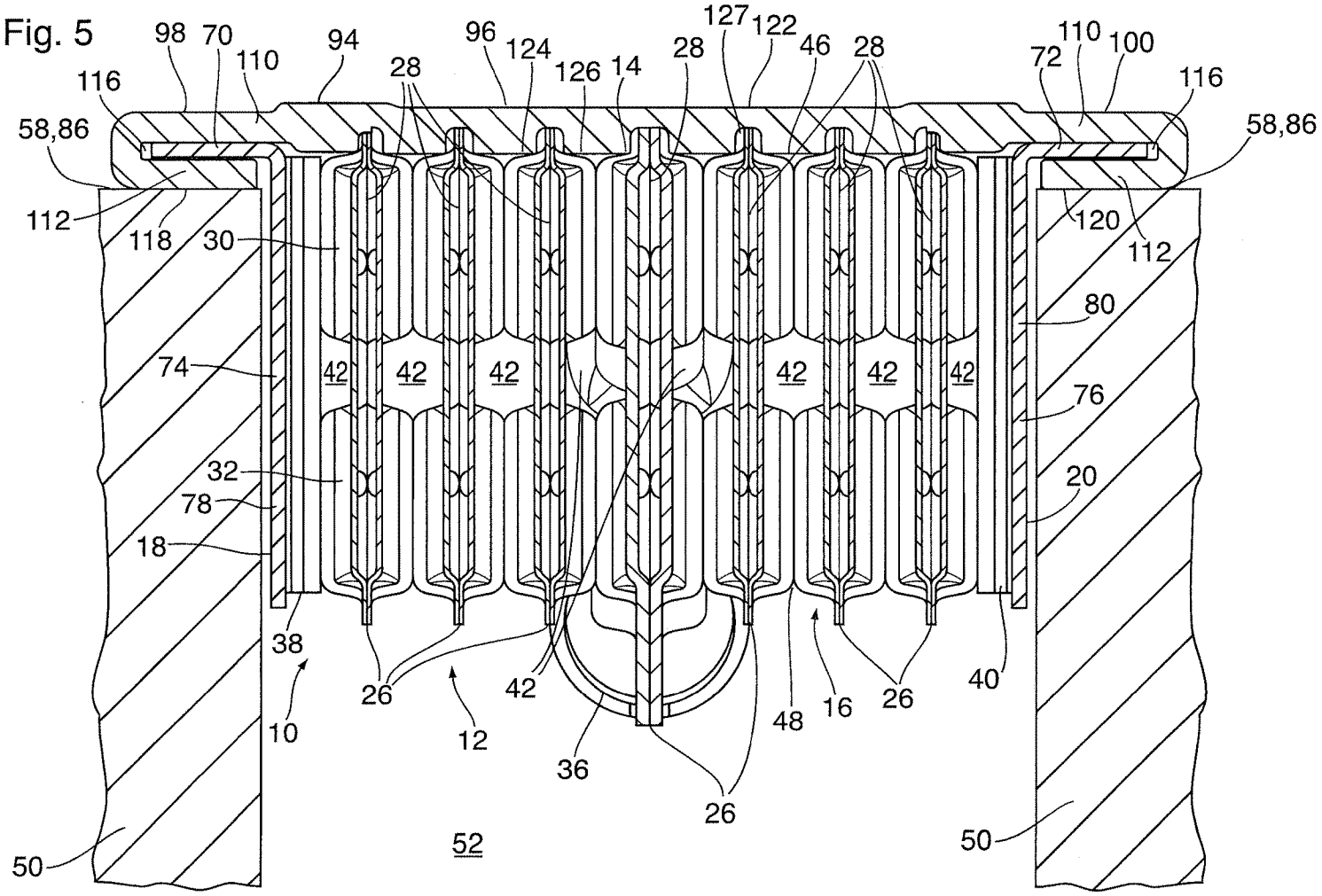
FIG. 5 is a transverse cross-section through the second end of the heat exchanger of FIG. 1.
Figure 6:
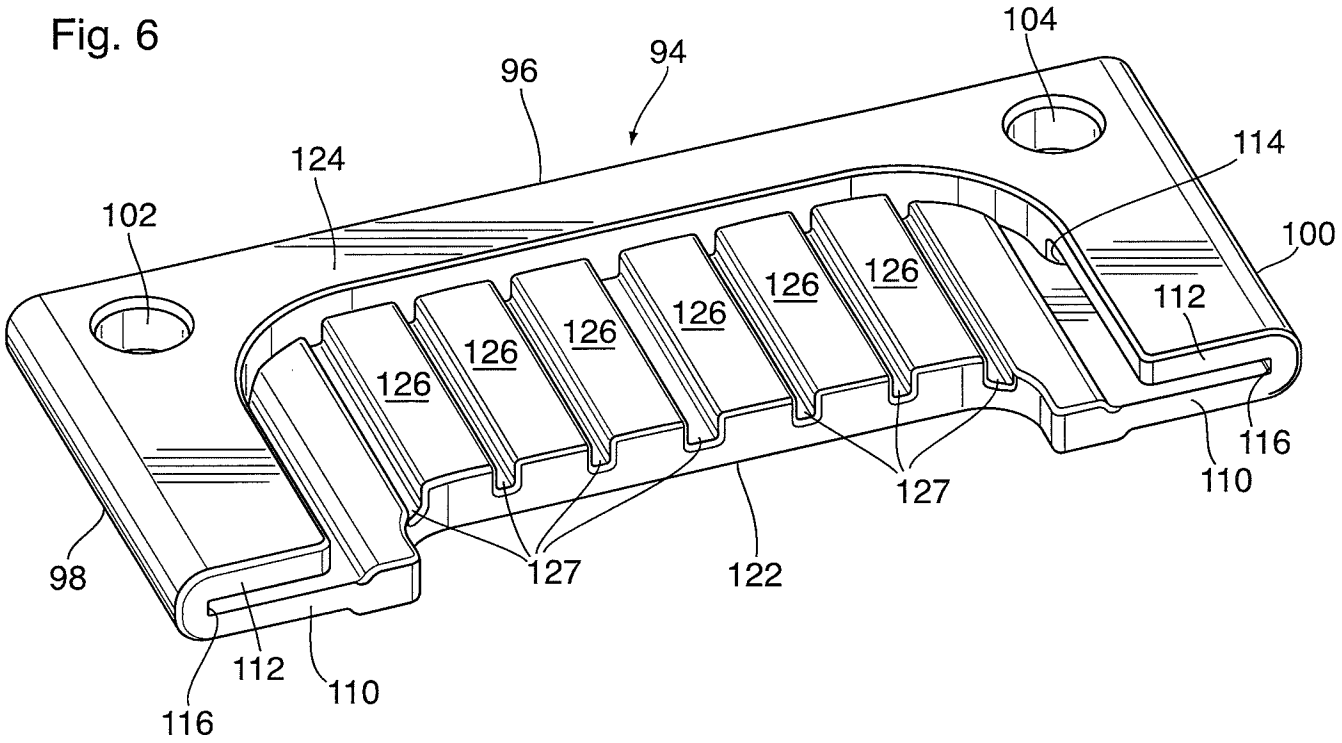
FIG. 6 is a bottom rear perspective view of a mounting bracket for the heat exchanger of FIG. 1.
Figure 7:
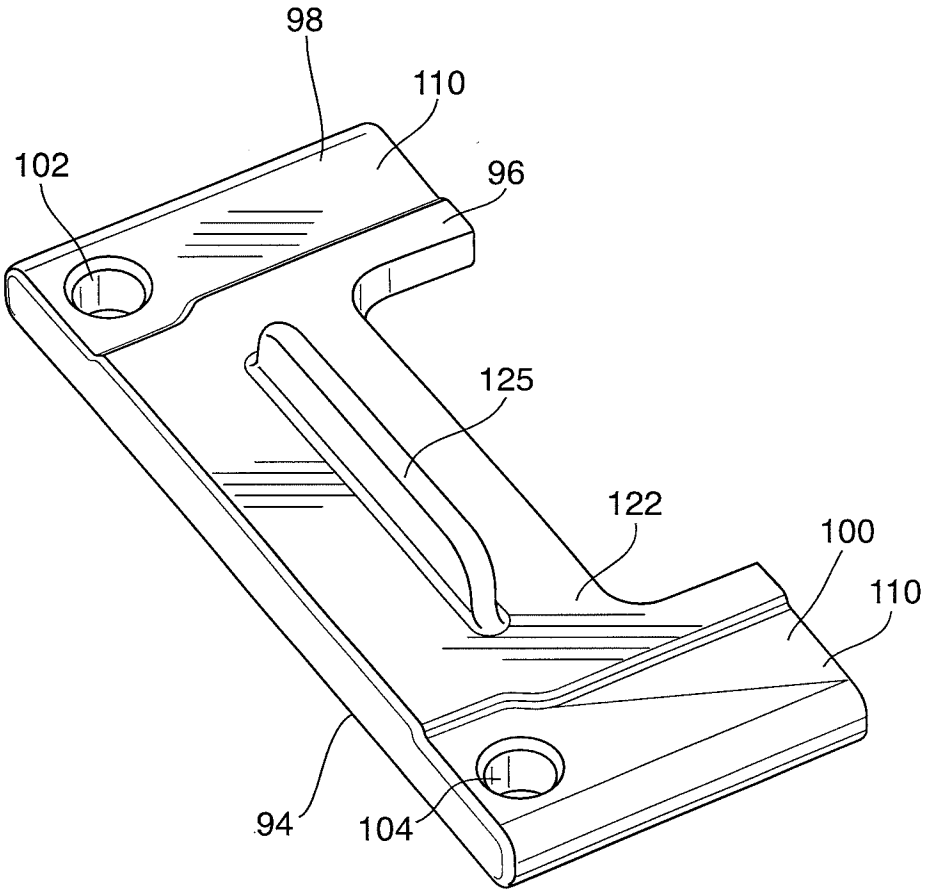
FIG. 7 is a top front perspective view of the mounting bracket of FIG. 6.

As shown in FIG. 5, the top and bottom layers 110, 112 of each edge portion 98, 100 are also joined along an axially extending line 116 located outwardly of the side edge of the side mounting flange 70 or 72, such that the slot or space between the top and bottom layers 110, 112 is open along its inner edge, and closed along both the transverse line 114 and the axial line 116.

Figure 2:
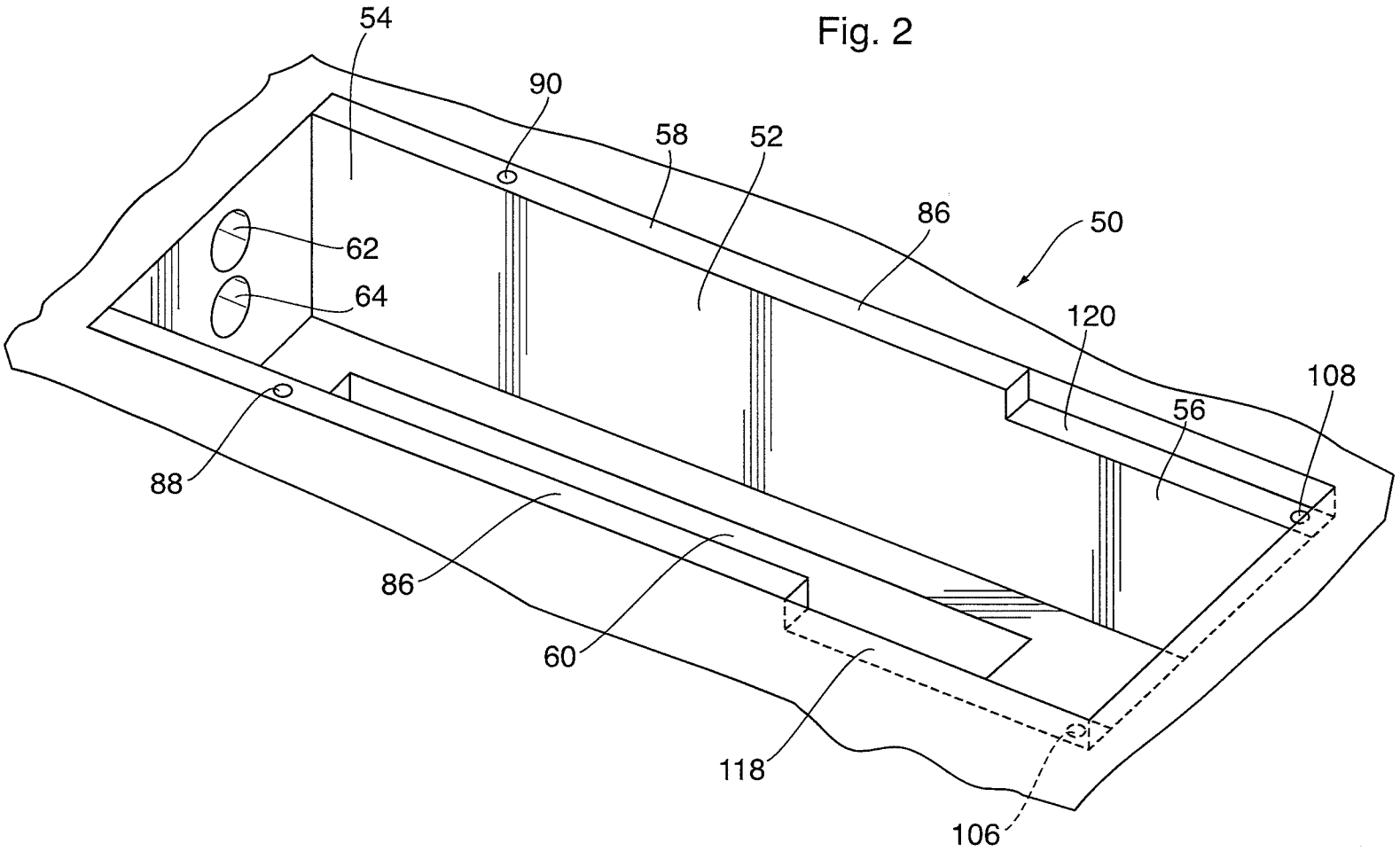
FIG. 2 shows a portion of a housing for the heat exchanger of FIG. 1.

Because the mounting bracket 94 includes top and bottom layers 110, 112 which enclose the side mounting flanges 70, 72, the bottom of bottom layer 112 extends below the bottom surface of side mounting flanges 70, 72 and is secured to the peripheral surface 86. Therefore, to maintain proper positioning of the heat exchanger 10 inside the cavity 52 of housing 50, it may be desired to recess a portion of the peripheral sealing surface 86 of the housing as shown in FIG. 2, the recessed portions 118, 120 corresponding to the second surface of the housing 50.

Figure 16:
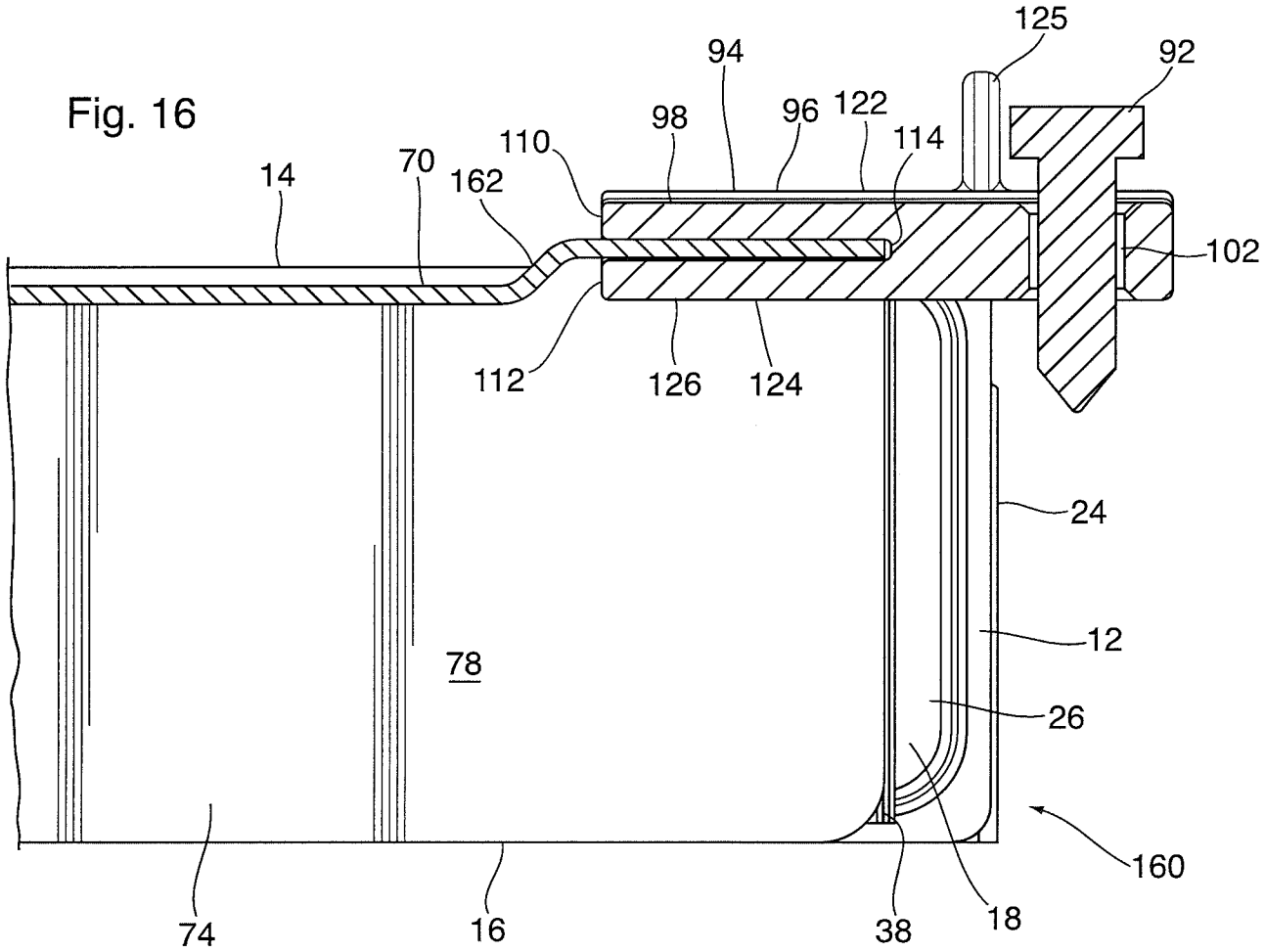
FIG. 16 shows a mounting arrangement according to a fifth embodiment.

Alternatively, rather than providing a recess in the peripheral sealing surface 86 of housing 50, it is possible to provide the side mounting flanges 70, 72 with different levels at the first and second ends 22, 24 of the core 12, in order to compensate for the thickness of the bottom layer 112 of the mounting bracket. This is shown in FIG. 16, which shows a heat exchanger 160 according to a fifth embodiment. Heat exchanger 160 is identical to heat exchanger 10 shown in FIG. 4, except that the side mounting flange 70 includes a step or shoulder 162, which raises the portion of mounting flange 70 received inbetween layers 110, 112 of bracket 94 by an amount which is equivalent to the thickness of bottom layer 112. Thus, in this embodiment, the bottom of bottom layer 112 is substantially co-planar with the bottom surface of side mounting flange 70 from shoulder 162 to the first end 22 of core 12. Although not shown in FIG. 16, the same arrangement is provided at the other side of core 12, with side mounting flange 72.

As best seen in FIG. 5, the central portion 96 of the mounting bracket 94 is adapted to cover a portion of the top 14 of core 12 proximate to the second end 24 thereof. The central portion 96 reduces the amount of bypass flow around the second end 24 of core 12, which can damage the edges of the corrugated cooling fins 44 located in the air passags 42 between the tubes 26. The central portion 96 has a top surface 122 and a bottom surface 124. The top surface 124 may include a finger grip 125. The bottom surface 124 is adapted to engage the top 14 of the core 12 when the mounting bracket 94 is in the installed position. To provide improved contact with the core 12, and to help block any bypass flow which may pass between the bottom surface 124 and the core 12, the bottom surface 124 may conform to the shape of the top 14 of core 12. For example, the top 14 of the plate and fin heat exchanger core 12 is defined by the edges of the tubes 26 and the fins 44 between the plates, with the edges of the fins 44 being lower (indented) than the edges of the tubes 26. Therefore, the bottom surface 124 of central portion 96 has a castellated appearance, having rectangular projections 126 which extend into the indentations between adjacent tubes 26, and with recesses 127 provided between the projections 126. It will be appreciated that the configuration of the bottom surface 124 of central portion is variable, and depends on the structure of the core 12.

A method for installation of heat exchanger 10 in housing 50 is now described with reference to FIGS. 8 to 10.

Figure 8:
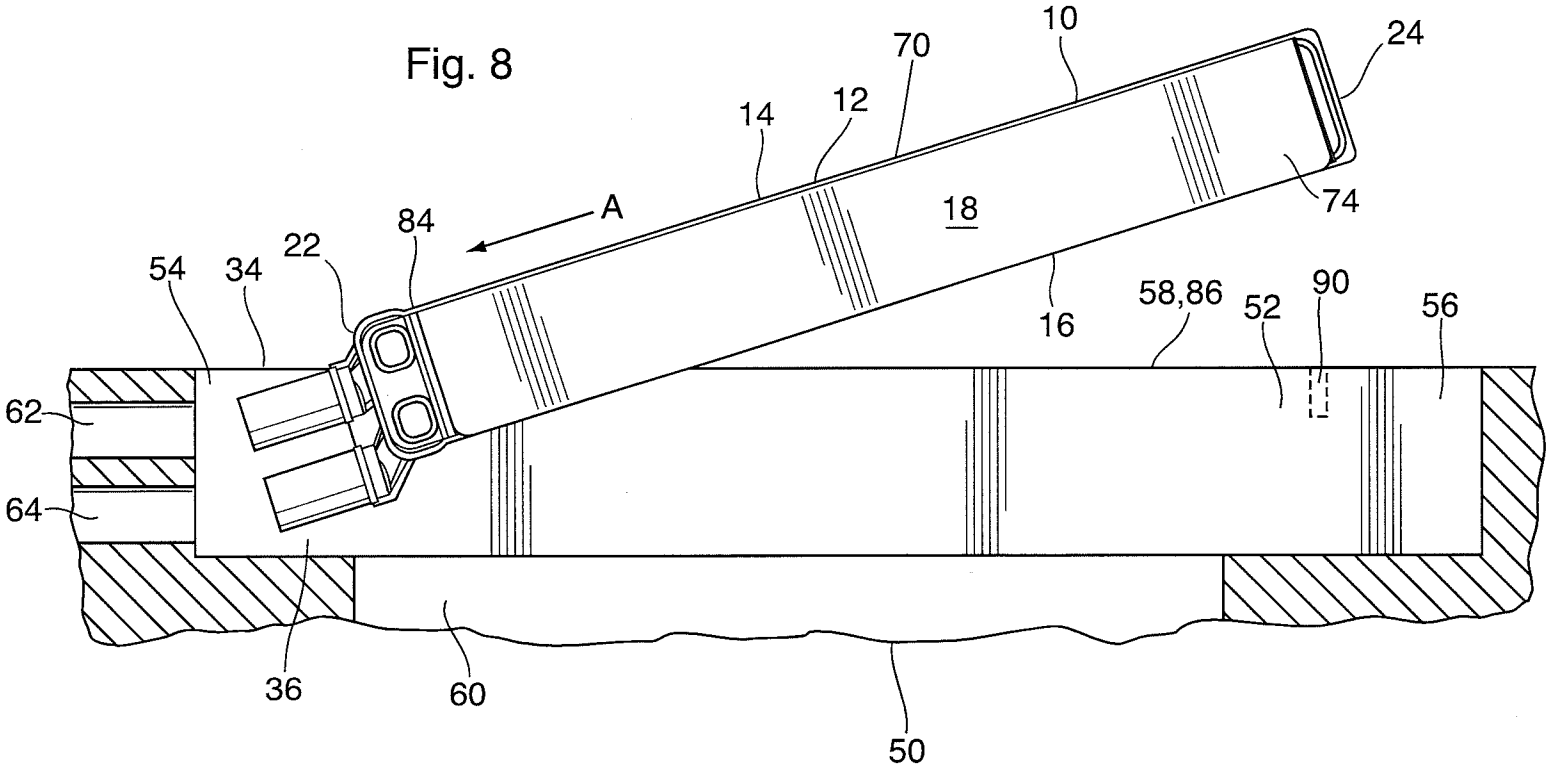
FIGS. 8 to 10 show the steps for installing the heat exchanger of FIG. 1 in the housing.

As shown in FIG. 8, the heat exchanger is inserted into the cavity 52 of housing 50 in the direction of arrow A, with the first end 22 entering the cavity 52 first. The coolant fittings 34, 36 projecting from the first end 22 are inserted into the coolant ports 62, 64, and a leak-proof, sealed connection is formed between fittings 34, 36 and ports 62, 64. The gap 56 between the second end 24 of core 12 and the end wall of cavity 52 permits the necessary clearance for the longitudinal displacement necessary to insert the coolant fittings 34, 36 into coolant ports 62, 64.

Figure 9:
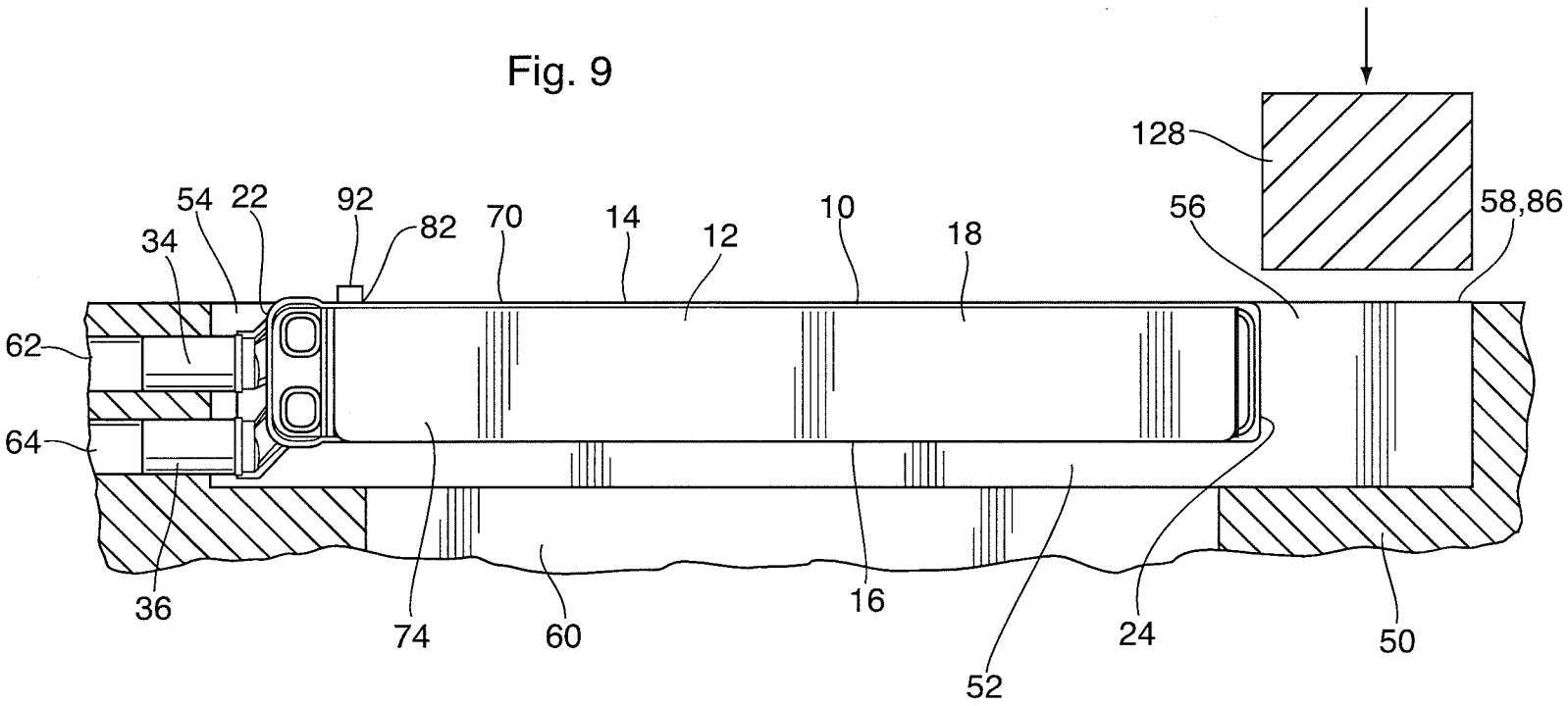
Figure 10:
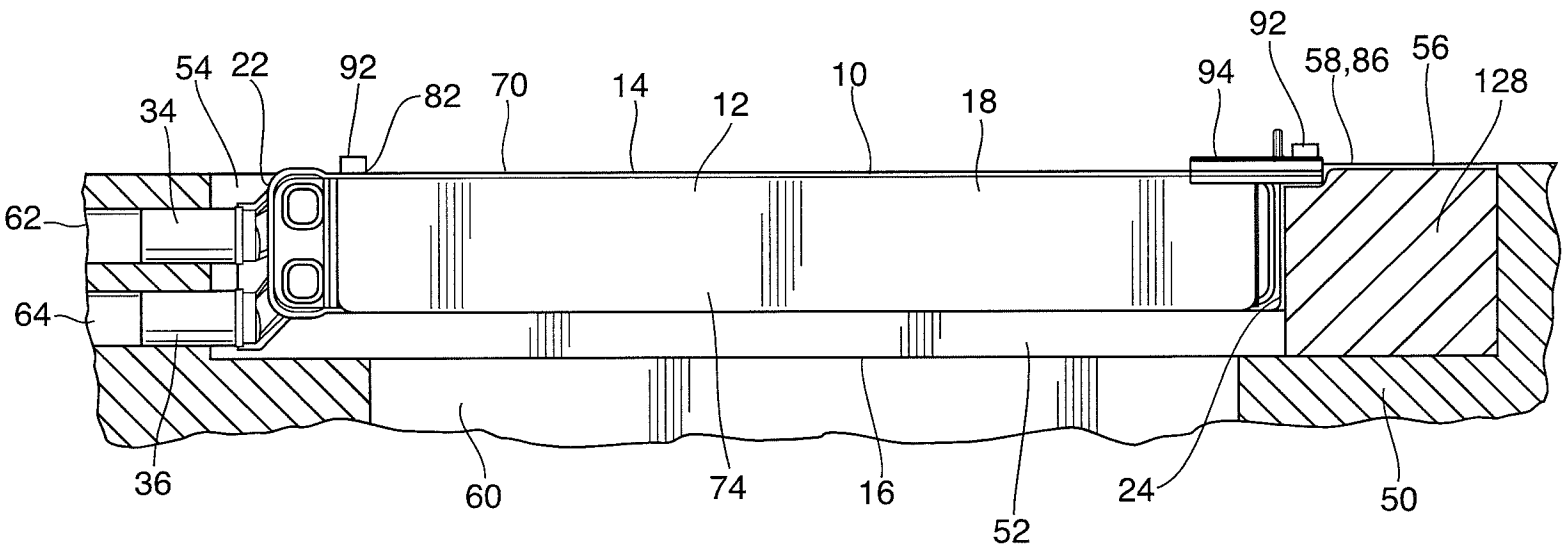
Figure 11:
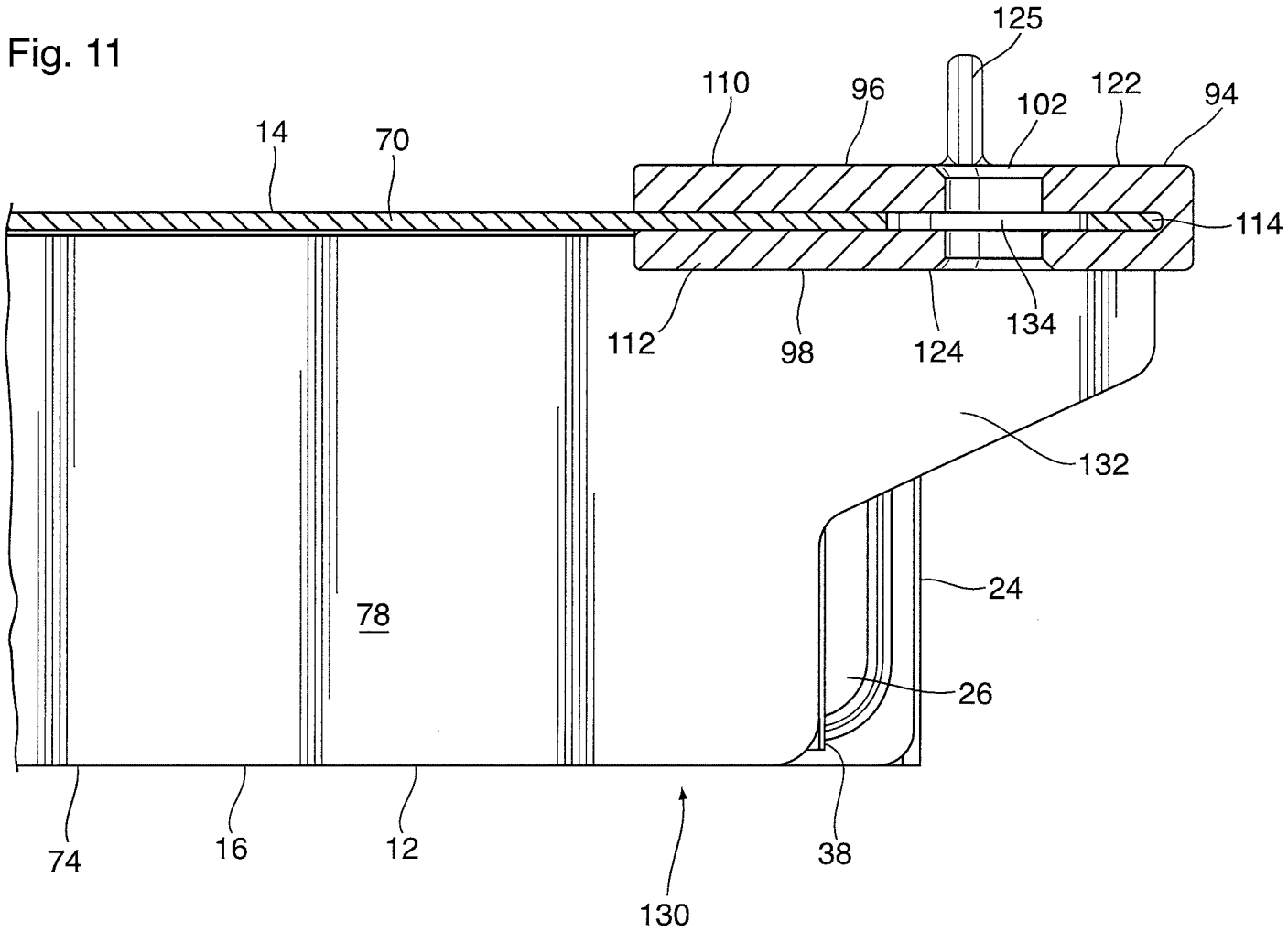
FIG. 11 is a partial, longitudinal cross-section through the second end of a heat exchanger according to a second embodiment.
Figure 12:
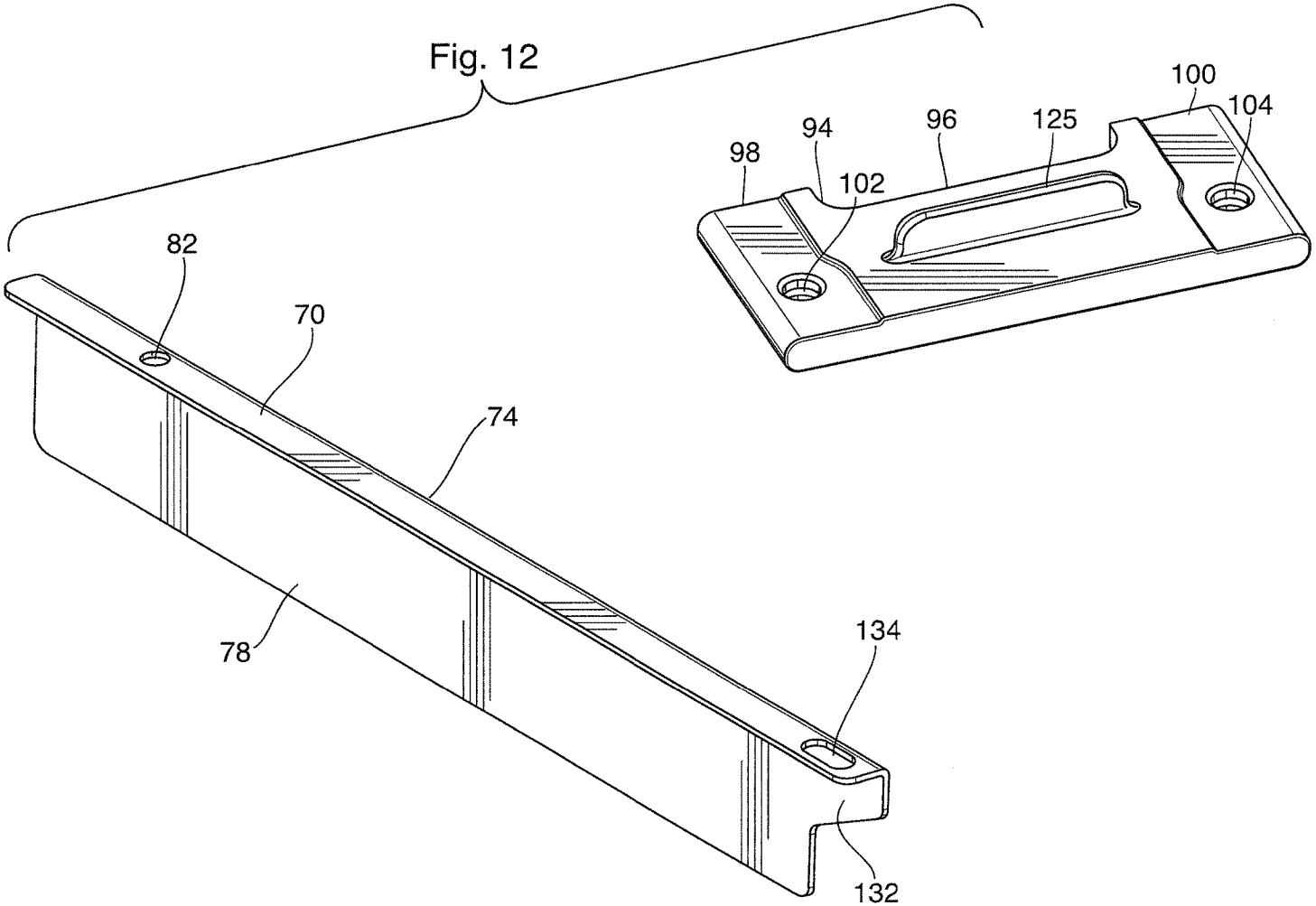
FIG. 12 is a top front perspective view showing a side bracket and the mounting bracket of the heat exchanger of FIG. 11.
Figure 13A:
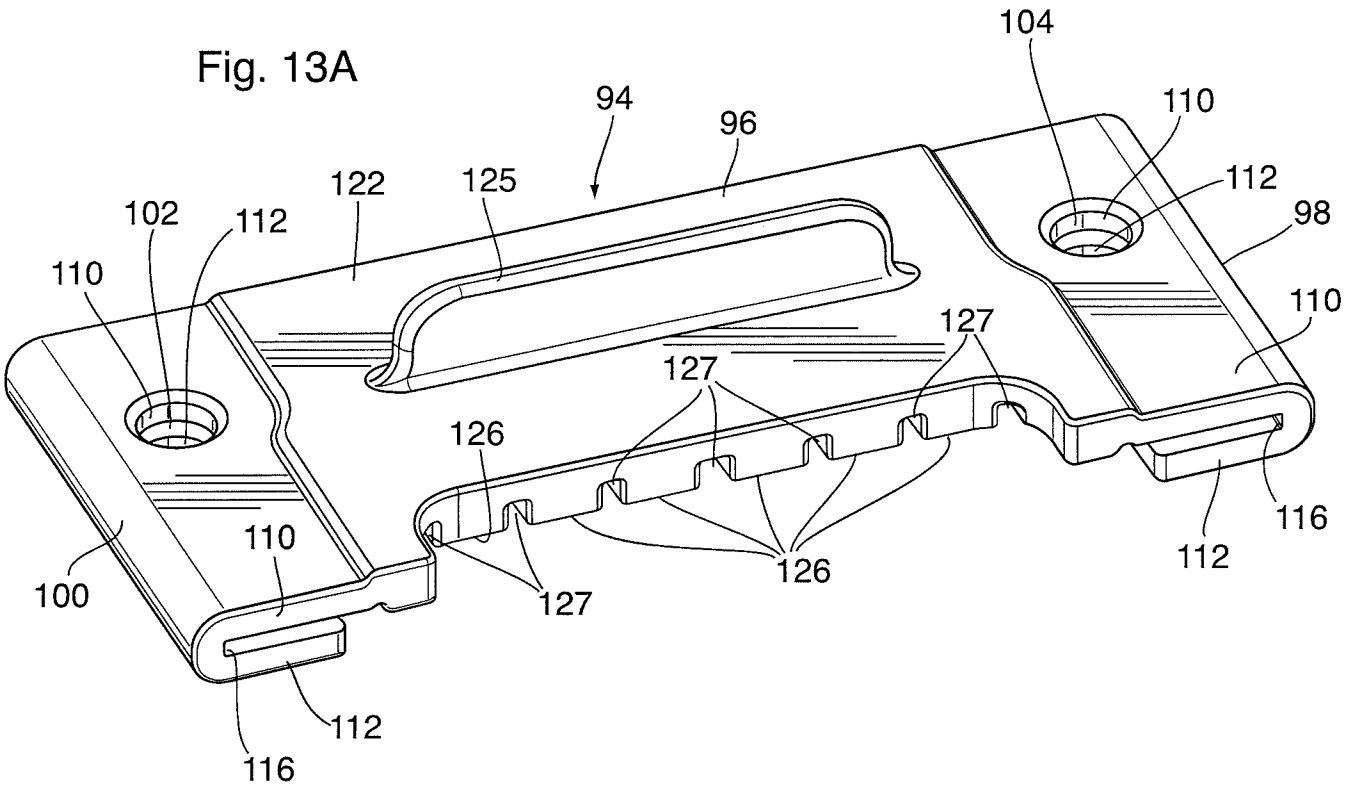
FIG. 13A is atop, rear perspective view of the mounting bracket of FIG. 12.
Figure 13B:
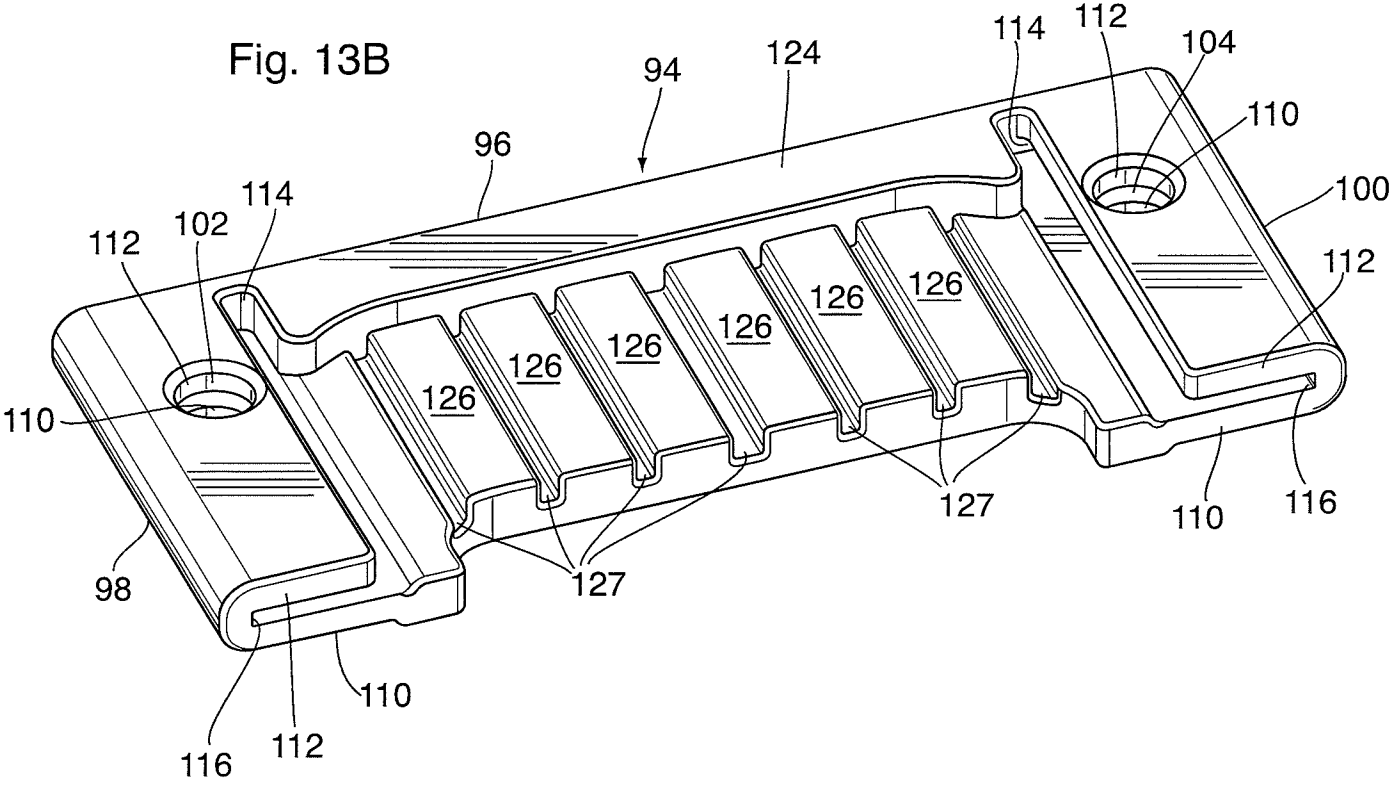
FIG. 13B is a bottom rear perspective view of the mounting bracket of FIG. 12.

Once the fittings 34, 36 are inserted into coolant ports 62, 64, the heat exchanger 10 has the orientation shown in FIG. 9, being completely received inside the cavity 52. The next step is to secure the first end 22 of core 12 to the peripheral sealing surface 86 by passing bolts 92 through the apertures 82, 84 of side mounting brackets 70, 72, and threading the bolts 92 into the openings 88, 90 in the sealing surface 86. At this point the first end 22 of core 12 is secured to housing 50.

Also referring to FIG. 9, a block 128 of a resilient material such as a foamed polymer or elastomer is fitted into the gap 56 at the second end 24 of core 12, the block 128 sealing any potential air bypass passages provided by gap 56. Although not shown in the drawings, a block of resilient material may also be provided at the first end 22 of core 12, this block being shaped to fit over the fittings 34, 36. It will be appreciated that the resilient block 128 may be inserted into the gap 56 before securing the first end 22 heat exchanger 10 to the housing 50.

Lastly, the mounting bracket 94 is fitted to the second end 24 of heat exchanger 10, such that the side mounting flanges 70, 72 are received in the slot between the top and bottom layers 110, 112. The bracket 94 is then pushed backward to the position shown in FIGS. 4 and 10, so that the side mounting flanges 70, 72 are fully received in the slot of the bracket 94, the apertures 102, 104 of the bracket 94 align with the threaded holes 106, 108, and such that a portion of bracket 94 is positioned over the resilient block 128, helping to keep it in position. Once bracket 94 is in this position, the bolts 92 are inserted through apertures 102, 104 and threaded into holes 106, 108, thereby retaining the second end 24 of heat exchanger 10 while permitting it to undergo longitudinal thermal expansion.

Turning now to FIGS. 11 to 13B, there is shown a heat exchanger 130 according to a second embodiment. The heat exchanger 130 includes a core 12 which is identical to that shown in FIGS. 1 to 7, with the only significant differences being in the side mounting flanges and the bracket. Therefore, like reference numerals are used to describe like elements of heat exchanger 130, and the following description is restricted to the differences between heat exchanger 10 and heat exchanger 130.

It can be seen that heat exchanger 130 includes side mounting flanges 70, 72 which are part of side mounting brackets 74, 76, respectively. The side mounting brackets 74, 76 of heat exchanger 130 are identical to those of the first embodiment, except that they each include an extension 132 which extends beyond the second end 24 of core 12 along longitudinal axis Z. Therefore, in the installed position shown in FIG. 11, it can be seen that the aperture 102 through edge portion 98 of mounting bracket 94 now lies in an area of edge portion 98 in which the edge portion 98 comprises a top layer 110 and a bottom layer 112, such that the aperture 102 is divided into an upper portion and a lower portion. The side mounting flange 70 is received between the top and bottom layers 110, 112 of the edge portion 98, and includes an aperture 134 which aligns with the upper and lower portions of aperture 102.

Thus, in the second embodiment, the side mounting flanges 70, 72 in the extensions 132 of side mounting brackets 74, 76 are bolted in position between the top and bottom layers 110, 112 of the side portions 98, 102. In order to permit longitudinal thermal expansion of the heat exchanger 10, the apertures 134 in the extensions 132 are axially elongated, and have the form of elongate slots.

Figure 14A:
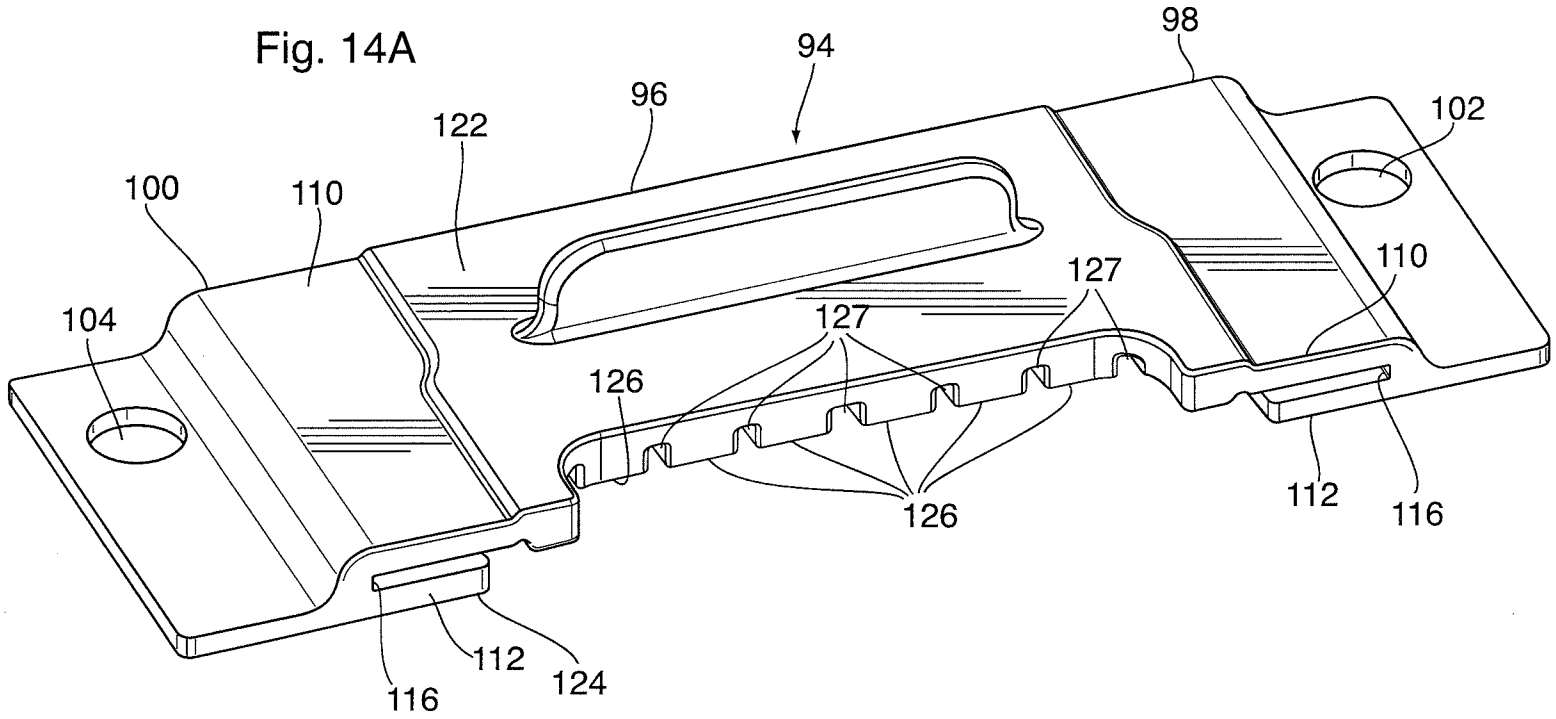
FIG. 14A shows a top rear view of a mounting bracket for a mounting arrangement according to a third embodiment.
Figure 14B:
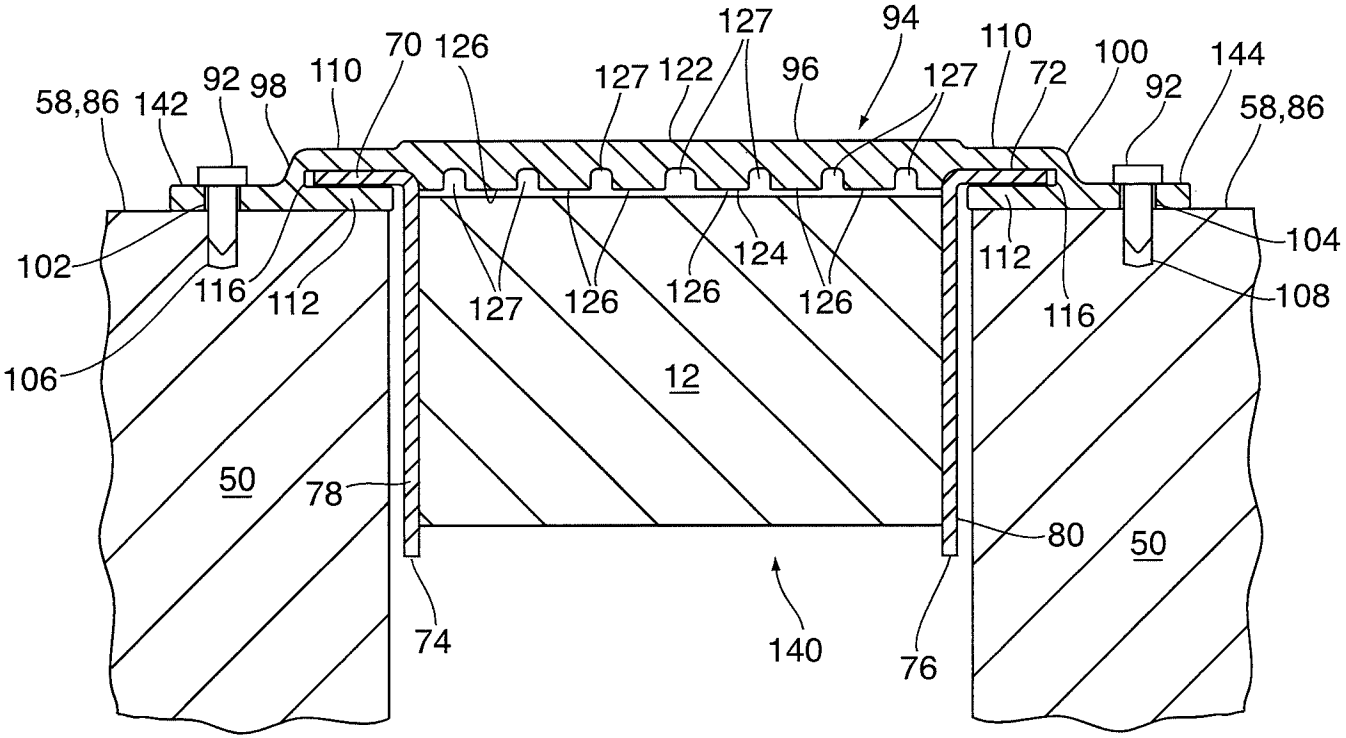
FIG. 14B shows the mounting arrangement according to the third embodiment.

A heat exchanger 140 according to a third embodiment is now described with reference to FIGS. 14A and 14B. Heat exchanger 140 has a core 12 which is identical to that of heat exchanger 10, with the differences between heat exchangers 10 and 140 being in the mounting bracket. Therefore, like reference numerals are used to describe like elements of heat exchanger 140, and the core 12 is only schematically shown in FIG. 14B. The following description is restricted to the differences between heat exchanger 10 and heat exchanger 140.

In heat exchanger 140, the edge portions 98, 100 of the mounting bracket 94 are wider than the side mounting flanges 70, 72, such that the apertures 102, 104 through the edge portions 98, 100 are located outwardly of the side edges of the side mounting flanges 70, 72 along axis X. The apertures 102, 104 are provided in side extensions 142, 144 which are coplanar with the bottom layer 112 of bracket 94, and may have a thickness similar to that of the bottom layer 112. This is a small variation on the bracket mounting arrangement of the first embodiment, in which the apertures 102, 104 are located beyond the end edges of side mounting flanges 70, 72 along axis X. Except for the presence of side extensions 142, 144, the mounting bracket 94 of the third embodiment is otherwise similar to the brackets 94 of the first and second embodiments.

A heat exchanger 150 according to a fourth embodiment is now described with reference to FIG. 15. Heat exchanger 150 has a core 12 which is identical to that of heat exchanger 10, with the differences between heat exchangers 10 and 150 being in the mounting bracket and in the side mounting flanges. Therefore, like reference numerals are used to describe like elements of heat exchanger 150, and the following description is restricted to the differences between heat exchanger 10 and heat exchanger 150.

Figure 15:
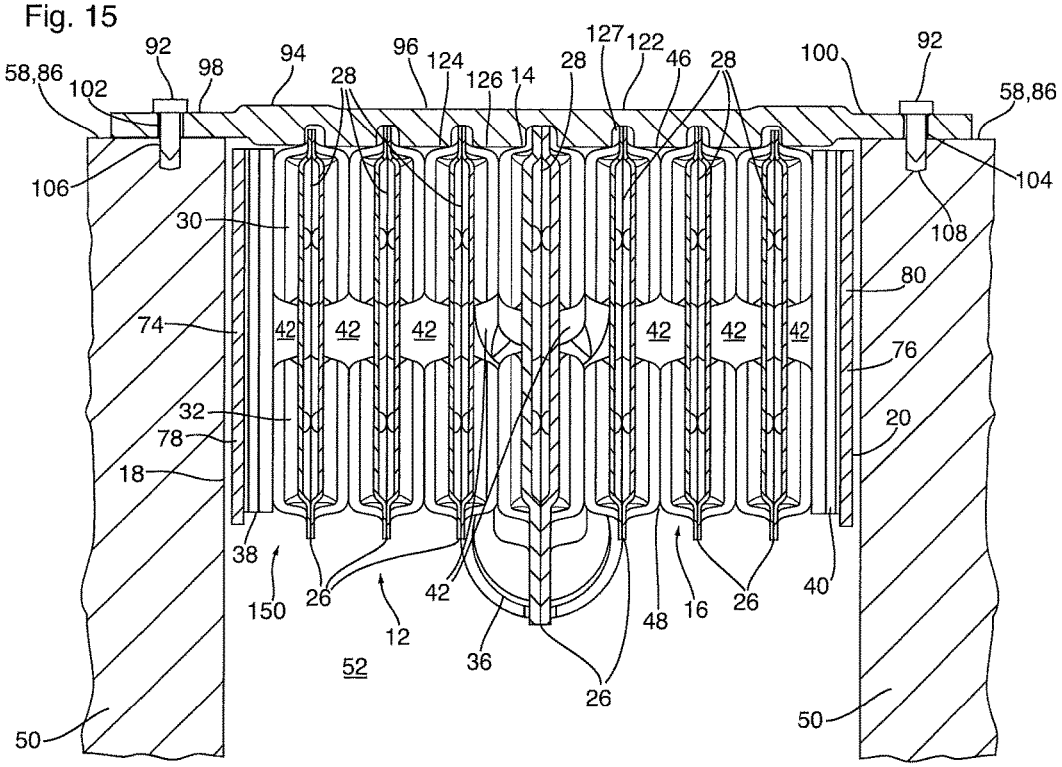
FIG. 15 shows a mounting arrangement according to a fourth embodiment.

It can be seen from FIG. 15, the edge portions 98, 100 of heat exchanger 150 do not include top and bottom layers 110, 112 to form a slot for the side mounting flanges 70, 72. Instead, the central portion 96 and edge portions 98, 100 are all formed of a single layer of material, and edge portions 98, 100 are secured by bolts 92 passing through apertures 102, 104 and threaded into holes 106, 108 of the sealing surface 86. It can be seen that the side mounting flanges 70, 72 do not underly the edge portions 98, 100. Rather, the side mounting flanges 70, 72 terminate short of the second end 24 of the core 12. Rather than using the side mounting flanges 70, 72 as bearing surfaces, the mounting bracket 94 according to the fourth embodiment bears on one or more of the tubes 26 of the core 12, including alternating projections 126 and recesses 127 so as to provide better contact with the core 12.

Although the invention has been described in connection with certain embodiments, it is not limited thereto. Rather, the invention includes all embodiments which may fall within the scope of the following claims.

What is claimed is:

1. A heat exchanger comprising:

(a) a core having a top, a bottom, a pair of sides, a first end and a second end, an inlet and an outlet for a first fluid, and an inlet and an outlet for a second fluid, the sides extending parallel to a longitudinal axis;

(b) a first mounting arrangement for securing the first end of the core to a first surface;

(c) a second mounting arrangement for securing the second end of the core to a second surface, wherein the second mounting arrangement comprises a pair of planar extensions located proximate to the second end of the core, each of the planar extensions being rigidly secured to one of the sides of the core and extending outwardly from the side to which it is secured;

(d) a mounting bracket for securing the second end of the core to the second surface, wherein the mounting bracket has a central portion and a pair of edge portions attached to the central portion and projecting therefrom, wherein the central portion is adapted to cover a portion of the top of the core proximate to the second end thereof, and has a width sufficient to extend across the top of the core, wherein, with the central portion covering said portion of the top of the core, the edge portions project outwardly from opposite sides of the central portion and from opposite sides of the core, with each of the edge portions being substantially parallel to one of the planar extensions, and wherein each of the edge portions has a top layer with a width sufficient to at least partially cover one of the planar extensions with the central portion covering said portion of the top of the core, and wherein each of the edge portions is adapted to be secured to the second surface;

wherein each of the edge portions of the mounting bracket has an aperture through which it is adapted to be secured to the second surface with a mechanical fastener;

wherein the top layer of each of the edge portions includes an area which lies outside an edge of one of the planar extensions with the central portion of the mounting bracket covering said portion of the top of the core; and wherein each of the apertures in the edge portions is located in one of said outer areas, such that the edge portions are adapted to be secured directly to the second surface without passing through the planar extensions.

2. The heat exchanger of claim 1, wherein the first mounting arrangement comprises a pair of planar extensions located proximate to the first end of the core, each of which is rigidly secured to one of the sides of the core and extends outwardly from the side to which it is secured; and wherein each of the planar extensions located proximate to the first end of the core is adapted to be secured to the first surface.

3. The heat exchanger of claim 2, wherein the first and second mounting arrangements are both provided by a pair of mounting flanges, each of the mounting flanges extending axially along one of the sides of the core between the first and second ends, and each of the mounting flanges being rigidly secured to one of the sides and extending outwardly from the side to which it is secured, wherein the first mounting arrangement comprises portions of the mounting flanges located proximate to the first end of the core and the second mounting arrangement comprises portions of the mounting flanges located proximate to the second end of the core.

4. The heat exchanger of claim 1, wherein the top layer of the edge portions are wider than the planar extensions, such that the outer areas are located outwardly of side edges of the planar extensions with the central portion of the mounting bracket covering said portion of the top of the core.

5. The heat exchanger of claim 4, wherein each of the edge portions of the mounting bracket further includes a bottom layer, wherein the top and bottom layers are planar and are separated by a space sufficient to receive one of the planar extensions in axial sliding relation;

wherein the top and bottom layers are joined along an axially extending line located outwardly of the side edge of the planar extension with the mounting bracket in the installed position, such that the space between the top and bottom layers of each of the mounting brackets defines an axially-extending slot which is open along its inner edge and closed along its outer edge.

6. The heat exchanger of claim 5, wherein the axially extending line is located inwardly of the aperture in each of the edge portions.

7. The heat exchanger of claim 1, wherein the mounting bracket protrudes beyond the second end of the core, and the outer areas of the edge portions are axially spaced from end edges of the planar extensions with the central portion of the mounting bracket covering said portion of the top of the core.

8. The heat exchanger of claim 7, wherein each of the edge portions of the mounting bracket further includes a bottom layer, wherein the top and bottom layers are planar and are separated by a space sufficient to receive one of the planar extensions in axial sliding relation;

wherein the top and bottom layers are joined along a transversely extending line located outwardly of the end edge of the planar extension with the mounting bracket in the installed position.

9. The heat exchanger of claim 8, wherein the top and bottom layers are also joined along an axially extending line located outwardly of the side edge of the planar extension with the central portion of the mounting bracket covering said portion of the top of the core, such that the space between the top and bottom layers of each of the mounting brackets defines an axially-extending slot which is open along its inner edge and closed along its outer edge and along a transverse edge defined by said transversely extending line.

10. A heat exchanger comprising:

(a) a core having a top, a bottom, a pair of sides, a first end and a second end, an inlet and an outlet for a first fluid, and an inlet and an outlet for a second fluid, the sides extending parallel to a longitudinal axis;

(b) a first mounting arrangement for securing the first end of the core to a first surface;

(c) a second mounting arrangement for securing the second end of the core to a second surface, wherein the second mounting arrangement comprises a pair of planar extensions located proximate to the second end of the core, each of the planar extensions being rigidly secured to one of the sides of the core and extending outwardly from the side to which it is secured;

(d) a mounting bracket for securing the second end of the core to the second surface, wherein the mounting bracket has a central portion and a pair of edge portions attached to the central portion and projecting therefrom, wherein the central portion is adapted to cover a portion of the top of the core proximate to the second end thereof, and has a width sufficient to extend across the top of the core;

wherein, with the central portion covering said portion of the top of the core, the edge portions project outwardly from opposite sides of the central portion and from opposite sides of the core, with each of the edge portions being substantially parallel to one of the planar extensions;

wherein each of the edge portions has a top layer with a width sufficient to at least partially cover one of the planar extensions with the central portion covering said portion of the top of the core, and wherein each of the edge portions is adapted to be secured to the second surface;

wherein the central portion of the mounting bracket has a top surface and a bottom surface, and wherein the bottom surface is adapted to engage the top of the core with the central portion of the mounting bracket covering said portion of the top of the core; and wherein the top of the core includes axially extending indentations, and wherein the bottom surface of the mounting bracket includes projections which extend into the indentations with the central portion of the mounting bracket covering said portion of the top of the core.

11. A heat exchanger comprising:

(a) a core having a top, a bottom, a pair of sides, a first end and a second end, an inlet and an outlet for a first fluid, and an inlet and an outlet for a second fluid, the sides extending parallel to a longitudinal axis;

(b) a first mounting arrangement for securing the first end of the core to a first surface;

(c) a second mounting arrangement for securing the second end of the core to a second surface, wherein the second mounting arrangement comprises a pair of planar extensions located proximate to the second end of the core, each of the planar extensions being rigidly secured to one of the sides of the core and extending outwardly from the side to which it is secured;

(d) a mounting bracket for securing the second end of the core to the second surface, wherein the mounting bracket has a central portion and a pair of edge portions attached to the central portion and projecting therefrom, wherein the central portion is adapted to cover a portion of the top of the core proximate to the second end thereof, and has a width sufficient to extend across the top of the core;

wherein, with the central portion covering said portion of the top of the core, the edge portions project outwardly from opposite sides of the central portion and from opposite sides of the core, with each of the edge portions being substantially parallel to one of the planar extensions;

wherein each of the edge portions has a top layer with a width sufficient to at least partially cover one of the planar extensions with the central portion covering said portion of the top of the core, and wherein each of the edge portions is adapted to be secured to the second surface;

wherein the first fluid is a liquid coolant, and the inlet and outlet for the first fluid both extend in a generally axial direction from the first end of the core;

wherein the second fluid is a hot gas, and wherein the inlet for the second fluid is located at the top of the core, and the outlet for the second fluid is located at the bottom of the core; and wherein the core comprises a plurality of spaced apart, elongate tubes, wherein flow passages for the first fluid are defined inside said tubes, and flow passages for the second fluid are defined between the tubes; and wherein the core further comprises a pair of side plates defining the sides of the core and a pair of L-shaped brackets, each of the brackets having one leg rigidly secured to one of the side plates, and one leg comprising an outwardly extending flange which defines said first and second mounting arrangements.

12. A heat exchanger comprising:

(a) a core having a top, a bottom, a pair of sides, a first end and a second end, an inlet and an outlet for a first fluid, and an inlet and an outlet for a second fluid, the sides extending parallel to a longitudinal axis;

(b) a first mounting arrangement for securing the first end of the core to a first surface;

(c) a second mounting arrangement for securing the second end of the core to a second surface, wherein the second mounting arrangement comprises a pair of planar extensions located proximate to the second end of the core, each of the planar extensions being rigidly secured to one of the sides of the core and extending outwardly from the side to which it is secured;

(d) a mounting bracket for securing the second end of the core to the second surface, wherein the mounting bracket has a central portion and a pair of edge portions attached to the central portion and projecting therefrom; and (e) a housing having an internal cavity adapted to receive the core, and axially-extending mounting surfaces extending along both sides of the cavity, wherein the mounting surfaces define both the first and second surfaces to which the first and second ends of the core are secured;

wherein the central portion is adapted to cover a portion of the top of the core proximate to the second end thereof, and has a width sufficient to extend across the top of the core;

wherein, with the central portion covering said portion of the top of the core, the edge portions project outwardly from opposite sides of the central portion and from opposite sides of the core, with each of the edge portions being substantially parallel to one of the planar extensions;

wherein each of the edge portions has a top layer with a width sufficient to at least partially cover one of the planar extensions with the central portion covering said portion of the top of the core, and wherein each of the edge portions is adapted to be secured to the second surface; and wherein the second surface is recessed relative to the first surface, wherein each of the edge portions of the mounting bracket further include a bottom layer, wherein the top and bottom layers are separated by a space sufficient to receive one of the planar extensions in axial sliding relation, and wherein the bottom layer of the mounting bracket is secured to the second surface with the central portion of the mounting bracket covering said portion of the top of the core.

13. The heat exchanger of claim 4, wherein the first and second mounting arrangements are both provided by a pair of mounting flanges, each of the mounting flanges extending axially along one of the sides of the core between the first and second ends, and each of the mounting flanges being rigidly secured to one of the sides and extending outwardly from the side to which it is secured, wherein the first mounting arrangement comprises portions of the mounting flanges located proximate to the first end of the core and the second mounting arrangement comprises portions of the mounting flanges located proximate to the second end of the core;

wherein each of the edge portions of the mounting bracket further includes a bottom layer, wherein the top and bottom layers are separated by a space sufficient to receive a portion of one of the mounting flanges in axial sliding relation;

wherein the space between the top and bottom layers of each of the mounting brackets defines an axially-extending slot; and wherein the mounting flanges each include a shoulder separating said portion of the mounting flange received between the top and bottom layers from a remainder of the mounting flange, wherein the remainder of the mounting flange has a bottom surface which is co-planar with a bottom surface of the bottom layer of the mounting bracket.

* * * * *